US012514368B2

(12) United States Patent
Felix

(10) Patent No.: US 12,514,368 B2
(45) Date of Patent: Jan. 6, 2026

(54) INTERACTIVE SEAT WITH GESTURE CONTROL

(71) Applicant: FAMA SOFAS, S.L.U., Yecla (ES)

(72) Inventor: Lopez Gil Felix, Yecla (ES)

(73) Assignee: FAMA SOFAS, S.L.U., Yecla (ES)

( * ) Notice: Subject to any disclaimer, the term of this patent is extended or adjusted under 35 U.S.C. 154(b) by 131 days.

(21) Appl. No.: 18/711,102

(22) PCT Filed: Jun. 10, 2022

(86) PCT No.: PCT/EP2022/065830

§ 371 (c)(1),
(2) Date: May 16, 2024

(87) PCT Pub. No.: WO2023/094035

PCT Pub. Date: Jun. 1, 2023

(65) Prior Publication Data

US 2025/0009130 A1 Jan. 9, 2025

(30) Foreign Application Priority Data

Nov. 23, 2021 (EP) ..... 21383058

(51) Int. Cl.
*A47C 1/024* (2006.01)

(52) U.S. Cl.
CPC ..... *A47C 1/0242* (2013.01)

(58) Field of Classification Search
None
See application file for complete search history.

(56) References Cited

FOREIGN PATENT DOCUMENTS

DE 202017102897 U1 * 6/2017 ..... A47C 7/72

* cited by examiner

*Primary Examiner* — Adam C Ortiz
(74) *Attorney, Agent, or Firm* — CRGO Global; Steven M. Greenberg

(57) ABSTRACT

Interactive seat (1) with gesture control comprising a plurality of moving parts (6,7,8); wherein said movable parts (6,7,8) are actuated by means of at least one electrical actuating device (5) according to a user's rest preferences; and wherein the interactive seat (1) also comprises: a means for detecting a user's gesture (2,3) located in the arms (9(*i*), 9(*d*)) of the seat (1); and consisting of at least two antennae (2,3) one for each arm (9(*i*), 9(*d*)) such that a first antenna (2) is located in the left arm (9*i*), while the second antenna (3) is located in the right arm (9*d*).

6 Claims, 2 Drawing Sheets

INTERACTIVE SEAT WITH GESTURE CONTROL

CROSS-REFERENCE TO RELATED APPLICATIONS

This application is a § 371 national phase entry of International Application No. PCT/EP2022/065830, filed Jun. 10, 2022, which claims priority to European Patent Application No. 21383058.1 filed on Nov. 21, 2021.

TECHNICAL FIELD

This invention relates to a new interactive seat comprising movable parts, which are activated by means of preferably electric actuators to position said parts according to the rest preferences of a user, who will control them by means of a given combination of gestures.

STATE OF THE PRIOR ART

In the current state of the art, relaxation seats or armchairs of any type, normally upholstered, are known, that are equipped with movable parts which allow the size, inclination of said movable parts and/or their ergonomics to be modified. The modification is achieved by acting on electronic controls or panels equipped with buttons and/or touch panels integrated into the seat itself or linked to it by cables.

The buttons and touch screens allow the user to electrically activate motors or linear actuators, which assist in adjusting the relative positions of the aforementioned movable parts until the appropriate or desired position is reached. Thus, all these seats must be operated by the user interacting with the seat by pressing the corresponding buttons or sensors, which undoubtedly sometimes affects the user's degree of comfort. These push buttons can be located in a wireless remote control or push buttons located in the seating or relaxation element, either in the armrest (outside or inside) or inside the seat.

In the state of the art, interactive seats-currently-present three problems:

I. An aesthetic problem as the buttons break the aesthetic line of the whole.

II. An ergonomic problem since short people cannot reach the button with their arms during the whole of the sofa's journey. In fact, when the backrest reclines, the body moves away from the button and the user's arms cannot reach the push button to continue pressing it.

III. The buttons, being within reach of children, may be pressed accidentally, or used inappropriately, for example, as a game. This problem causes a lack of safety for the children themselves and obliges parents to disconnect the armchairs to disable the motorised mechanism.

Finally, when the buttons are located on the inside of the chair, the usage problem that presents itself is that they are hidden, and it is complicated for many users to find their location and have difficulty in distinguishing which button moves the motor forward and which one moves it backwards.

To avoid these problems, activation systems using optical sensors have been described in the state of the art. These sensors are configured to detect whether the hand passes in front of the sensor to activate/deactivate the motor. However, it is a system that requires more frequent maintenance (optical sensors tend to degrade with use and dirt), as well as requiring very specific gestures to avoid accidental activations, which makes its operation imprecise.

This invention is also particularly related to the use of armchairs known as "POWERLIFT", which are relaxation armchairs that have a motorised device that raises the armchair to make it easier for people with reduced mobility to get up from the seat without effort. However, this type of armchair usually has a remote control with push buttons to open and close the relaxation mechanism, as well as to raise and lower the armchair. This remote control usually has an extendable spiral cable or is wireless. Normally, these remote controls are placed in a pocket located on the outside of one of the arms. Therefore, one problem intended to be solved by this invention is to avoid the use of remote controls.

Furthermore, if the person using the seat has any kind of motor or sensory disability, it is even more difficult to access the correct positioning of the movable parts of the seat. This problem is partly resolved by patent EP3556251B1, from the same applicant as this invention, which constitutes the closest prior art to this invention. Vehicle seats controlled by gestures are known from documents WO2015/148774A1 and DE102015222715A1.

EXPLANATION OF THE INVENTION

One objective of this invention is to improve the usability of interactive seats. As previously indicated with reference to the prior art, motorised relaxation seats are known which are activated by mechanical and/or tactile push buttons. However, these push buttons are usually located on the inside of seats and are difficult to find for many users, above all, the elderly. In the aforementioned document, EP3556251B1, from the same applicant as this invention, this problem is resolved with pressure sensors in the seat, front and backrest. However, the object of this invention is to improve the usability of the relaxation seat by means of gesture control that works by proximity and which are activated when a user's hand approaches.

More specifically, this invention is a device provided with one antenna per armchair seat, wherein each antenna is connected to a circuit configured to detect the proximity of a user's hand. In addition, each antenna is located on the outside of each arm of the seat. Thus, when a user's hand approaches the outside of the right arm, the relaxation mechanism begins to open and when the hand is placed on the outside of the left arm, the relaxation mechanism closes. Furthermore, the moment the hand is removed or moved away, the relaxation mechanism stops, whether it is opening or closing.

In short, one problem that this invention resolves is to avoid the use of remote controls and complex push buttons to raise and/or lower the armchairs, above all for elderly and/or very elderly users—for example, for use in old people's homes. Thanks to this invention, an elderly user knows that by placing his/her right hand on the outer side of the right arm of the seat, the armchair is raised; while, if he/she places his/her left hand on the outer side of the left arm of the seat, the armchair is lowered. These are, therefore, easy and intuitive gestures that make the use of a remote control, or learning how to operate it, unnecessary, improving the usability of the interactive seat.

An important advantage of this invention is that, as the activator is a proximity antenna with an adjustable radius of action, it allows a larger activation area than that represented by a single push button, which in many cases, in the current state of the art, is out of reach of the user's hand.

The stated problems and objects are solved by means of the interactive seat of claim 1. Different aspects of the invention are described in the dependent claims. Throughout the description and the claims, the word <<comprises>> and variants thereof, are not intended to exclude other technical characteristics, additives, components or steps. For those skilled in the art, other objects, advantages and characteristics of the invention will be apparent in part from the invention and in part from putting the invention into practice. The following examples and drawings are provided by way of illustration and are not intended to restrict this invention.

Furthermore, the invention covers all possible combinations of particular and preferred embodiments indicated herein.

BRIEF DESCRIPTION OF THE DRAWINGS

The following is a very brief description of a series of drawings that help to understand the invention better and which relate expressly to one embodiment of said invention, which is illustrated as a non-limiting example of it.

EXPLANATION OF A PREFERRED EMBODIMENT OF THE INVENTION

Figure 1:
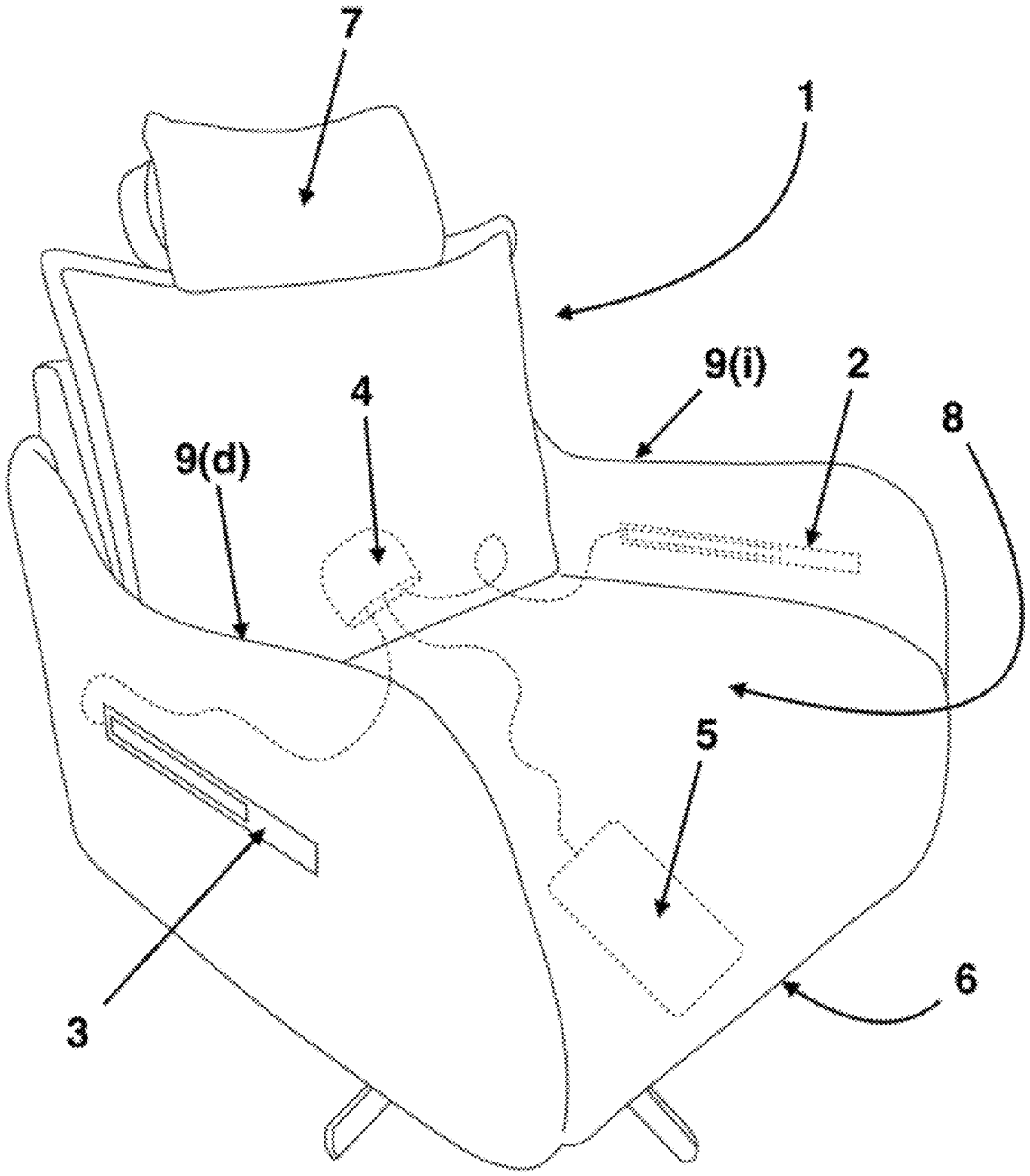
FIG. 1 shows schematically a perspective view of the interactive seat with gesture control in accordance with one practical embodiment of this invention.

As can be seen in the attached figures, the interactive seat of the invention, in a practical embodiment of the invention is an interactive seat incorporating a relaxation mechanism. The relaxation armchair 1, therefore, comprises at least two antennae 2 and 3, one for each arm 9(*i*) and 9(*d*) of the relaxation armchair 1. The antennae 2, 3 are located on the outside of its respective arms 9(*i*) and 9(*d*); in such a way that a first antenna 2 is located in the left arm 9*i*, while the second antenna 3 is located in the right arm 9*d*. Preferably, the antennae (2,3) will be located on the outside parts of the arms (9*d*, 9*i*) logically invisibly, underneath the upholstery, although they could also be on the inside of the arms.

The antennae 9(*i*) and 9(*d*) are connected electrically with a control device 4, which is configured to receive and process the signal captured by the antennae 2,3. In addition, the control device 4 is connected to the motor or motors 5 to perform a series of actions such as, for example, collapsing the footrest 6, tilting the backrest 7 and/or raising the surface of the seat 8.

Figure 2:
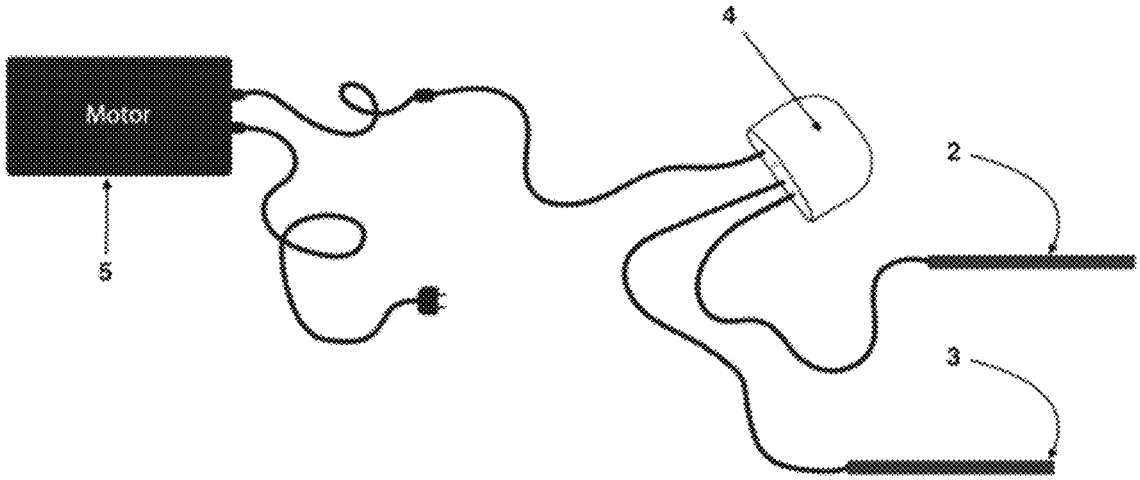
FIG. 2 shows a diagram of the gesture control device implemented in the interactive seat of the practical embodiment of this invention shown in FIG. 1.

Referring now to FIG. 2, the electronic control device 4 comprises at least one conditioning circuit for the signal coming from each antenna 2,3; a processor or processors; a memory or memories; wherein the programme or programmes are stored in the memory and configured to be executed by means of the processor or processors; characterised in that the programmes include instructions for:

sending the necessary instructions to the motor or motors 5 that command the opening mechanism of the relaxation armchair 1 when a gesture sequence for opening the armchair 1 is detected in each of the antennae 2 and 3; and/or sending the necessary instructions to the motor or motors 5 that command the closure of the mechanism of the relaxation armchair 1 when a gesture sequence for closing the armchair 1 is detected in each of the antennae 2 and 3; and/or sending the necessary instructions to the motor or motors 5 that command the stopping and locking mechanism of the relaxation armchair 1 when a gesture sequence for stopping and locking the armchair 1 is detected in each of the antennae 2 and 3.

Thanks to this configuration, this invention makes it possible to implement a gesture control method for the interactive seat. The different gesture sequences are intended to prevent accidental openings or closures in homes or establishments where, for example, there may be small children, or where involuntary leaning on the arms 9 may occur and the motor or motors 5 may be activated unnecessarily—something that usually occurs with remote controls, buttons or touch screens—. For this purpose, a detection code is created to detect the approach of a user's hands to each of the antennae 2 and 3, which are processed individually and avoid accidental activation of the armchair 1.

A practical example of the gesture sequences implemented in the invention are as follows:

To activate the opening of the armchair 1, first, the left hand is rested on the left arm 9(*i*) of the armchair 1 and, without removing it, the right arm is rested on the right arm 9(*d*), in such a way that the left antenna 2 is activated first, and with this signal activated, the presence signal is detected in the right antenna 3, so that the motor or motors 5 are activated and the armchair opens. In other words, the footrest 6 opens, the backrest 7 is tilted and the surface of the seat 8 is raised.

To establish the closing sequence of the armchair 1, the footrest 6 closes, the backrest 7 is raised and the surface of the seat 8 is lowered, the opposite operation to the opening activation sequence is performed, i.e., first, the right hand will be placed on the right arm 9(*d*) of the armchair 1, followed by the left hand being placed on the right arm 9(*i*) of the armchair 1.

To stop the opening, the right hand will be raised (i.e., the right antenna 3 will stop detecting the hand), which will cause any subsequent action to block the movement of the armchair 1.

In addition to the above, and to facilitate use, in a particular embodiment of the invention, the type of operation is controlled via an application installed on a smart phone. Within this application, furthermore, it will be possible to block the operation of the seat so that children or disabled people are unable to activate it. In addition, it is possible to select the mode of operation for one or two hands. This means that it is possible to programme the gestures so that it is not necessary to use both hands (as described above) but just one hand. It is also possible for a user to establish previously programmed operating periods, so that, at a determined time, the seat is activated and deactivated at a different time.

In short, this invention aims to improve the usage conditions of the seat, not only for the elderly or people with some kind of impairment or disability, but for any user.

The invention claimed is:

1. An interactive seat with gesture control comprising a plurality of movable parts;

wherein said movable parts are activated by means of at least one electrical actuating device according to a user's rest preferences;

and wherein the interactive seat further comprises:

a means for detecting a user's gestures located in the arms, of the seat; and an electronic control device connected to the electrical actuating device and to the means for detecting a user's gestures such that the electronic control device activates the movable parts by means of at least one electrical actuating device when a gesture sequence executed by a user is detected;

wherein the means for detecting a user's gestures consists of at least two antennae one for each arm such that a first antenna is located in the left arm, while the second antenna is located in the right arm.

2. The interactive seat of claim 1 wherein the electronic control device comprises at least:

a conditioning circuit for the signal coming from each of the antennae;

a processor or processors;

a memory or memories; and one or more programs; wherein the program or programs are stored in the memory and configured to be executed by means of the processor or processors;

wherein the programs include instructions for:

sending the opening instructions to at least one electrical actuating device when a gesture sequence for opening the armchair is detected in each one of the antennae; and/or sending the closing instructions to at least one electrical actuating device when a gesture sequence for closing the armchair is detected in each one of the antennae; and/or sending stopping and locking instructions to at least one electrical actuating device that command the stopping and locking of the relaxation mechanism of the armchair when a gesture sequence for stopping and locking the armchair is detected in each of the antennae.

3. The seat according to claim 1 wherein the opening gesture sequence comprises consists of:

(a) detecting the left hand on the left arm of the armchair by means of the left antenna; and then, with the signal from the left antenna active, (b) detecting the right hand on the right arm by means of the right antenna.

4. The seat according to claim 1 wherein the closing gesture sequence comprises:

(a) detecting the right hand on the right arm of the seat by means of the right antenna and with the signal from the right antenna active, (b) detecting the left hand on the left arm of the seat by means of the left antenna.

5. The seat according to claim 1, wherein the stopping gesture sequence comprises ceasing to detect the right hand on the right arm of the seat by means of the right antenna, which will cause any subsequent action to block the movement of at least one electrical actuating device.

6. The seat according to claim 1, wherein the movable parts are at least one footrest, a backrest and a seat.

* * * * *